US006672903B1

(12) United States Patent
Chen

(10) Patent No.: US 6,672,903 B1
(45) Date of Patent: Jan. 6, 2004

(54) SIGNAL-LINE CONNECTOR

(76) Inventor: Ting-Chu Chen, No. 61-7, Shanbi Tsuen, Luju Shiang, Taoyuan 338 (TW)

( * ) Notice: Subject to any disclaimer, the term of this patent is extended or adjusted under 35 U.S.C. 154(b) by 0 days.

(21) Appl. No.: 10/347,793

(22) Filed: Jan. 22, 2003

(51) Int. Cl.[7] ..... H01R 9/03
(52) U.S. Cl. ..... 439/610; 439/101; 439/578; 439/735; 439/744
(58) Field of Search ..... 439/610, 101, 439/578, 744, 735

(56) References Cited

U.S. PATENT DOCUMENTS 4,867,692 A * 9/1989 Kerek ..... 439/101
5,711,676 A * 1/1998 Michael, III ..... 439/63
5,938,450 A * 8/1999 Nagafuji ..... 439/63
6,143,205 A * 11/2000 Sutoris et al. ..... 252/405
6,485,335 B1 * 11/2002 Dewdney ..... 439/610
6,491,546 B1 * 12/2002 Perry ..... 439/620
6,494,746 B2 * 12/2002 D'Addario ..... 439/668
6,568,964 B2 * 5/2003 D'Addario ..... 439/675
6,596,939 B1 * 7/2003 Gretz ..... 174/65 R

* cited by examiner

*Primary Examiner*—Truc Nguyen
(74) *Attorney, Agent, or Firm*—Bacon & Thomas

(57) ABSTRACT

A signal-line connector includes a connecting member, a rod-shaped conductor, a plurality of grounding members and a shell. After the connecting member, the conductor and the grounding members are assembled together with and in the shell, the conductor and the grounding members are separated by separating members to prevent signal lines connected with the conductor and the grounding members from contacting with each other accidentally, and the metal material needed for the grounding members are much saved, and their resistance is reduced a lot, with the capacitance between the grounding members and the non-metal connecting member lessened mush so that the signal-line connector may have good contact and signal transmission.

4 Claims, 4 Drawing Sheets

SIGNAL-LINE CONNECTOR

BACKGROUND OF THE INVENTION

1. The Field of the Invention

This invention relates to a signal-line connector, particularly to one having a structure of good contact not affected by use for a long period of time, and not interfering signals transmitted.

2. Description of the Prior Art

A conventional signal-line connector shown in FIG. 1 includes a tubular member (A) and an insert member (B). The tubular member (A) has female threads A1 formed in an inner wall, and the insert member (B) has an insert rod B1, a grounding member B2 and male threads B3. The insert rod B1 has a semi-circular strip B11 formed in a rear end for connecting a signal line. Then the tubular member (A) and the insert member (B) are combined together by engaging the female threads A1 with the male threads B3, finishing assembly of the conventional signal-line connector.

However, the conventional signal-line connector is generally made of bronze, having the grounding member B2 exposed out of the whole signal-line connector body and shaped as a cone made of a plurality of petals so that it needs comparatively much material and will become to contact not so well with another connector after a long period of use. Consequently, signals may be worsened by bad contact of the conventional signal-line connector, impossible to enable a high-quality electronic appliance such as TV present excellent image or the like.

In addition, the grounding member B2 is made up of an annular member and a strip member riveted together (not shown), inconvenient to make and increasing its resistance by two members and high capacitance caused by the metal annular members as well, resulting in inferior transmission.

SUMMARY OF THE INVENTION

The purpose of this invention is to offer a signal-line connector with the material saved, and having a good contact by means of constrict after inserting a conductor in an internal hole of a shell, having good signal transmission and a long durable life.

Another purpose of the invention is to offer a signal-line connector, which has a conductor separated from two grounding members by two separating strips designed to have elasticity so as to lower the capacitance between the two poles.

The feature of the invention is a connecting member, conductors, two grounding members and a shell combined together with tightness. The connecting member has an open end and a closed end, and the closed end has male threads on an outer surface, a through hole and a plurality of fitting grooves respectively for a rod-shaped conductor and the grounding members to combine with. And separating strips are provided between the through hole and the fitting grooves so that the rod-shaped conductor is separated completely from the grounding members so as to prevent signal lines to contact accidentally to worsen transmission of the signals. Besides, the grounding members have a semi-circular end to tighten contact in inserting of the rod-shaped conductor, possible to lessen resistance by forming it integral, and also to decrease capacitance by insulating plastic used in the connecting member, obtaining the result of good contact and smooth signal transmission.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
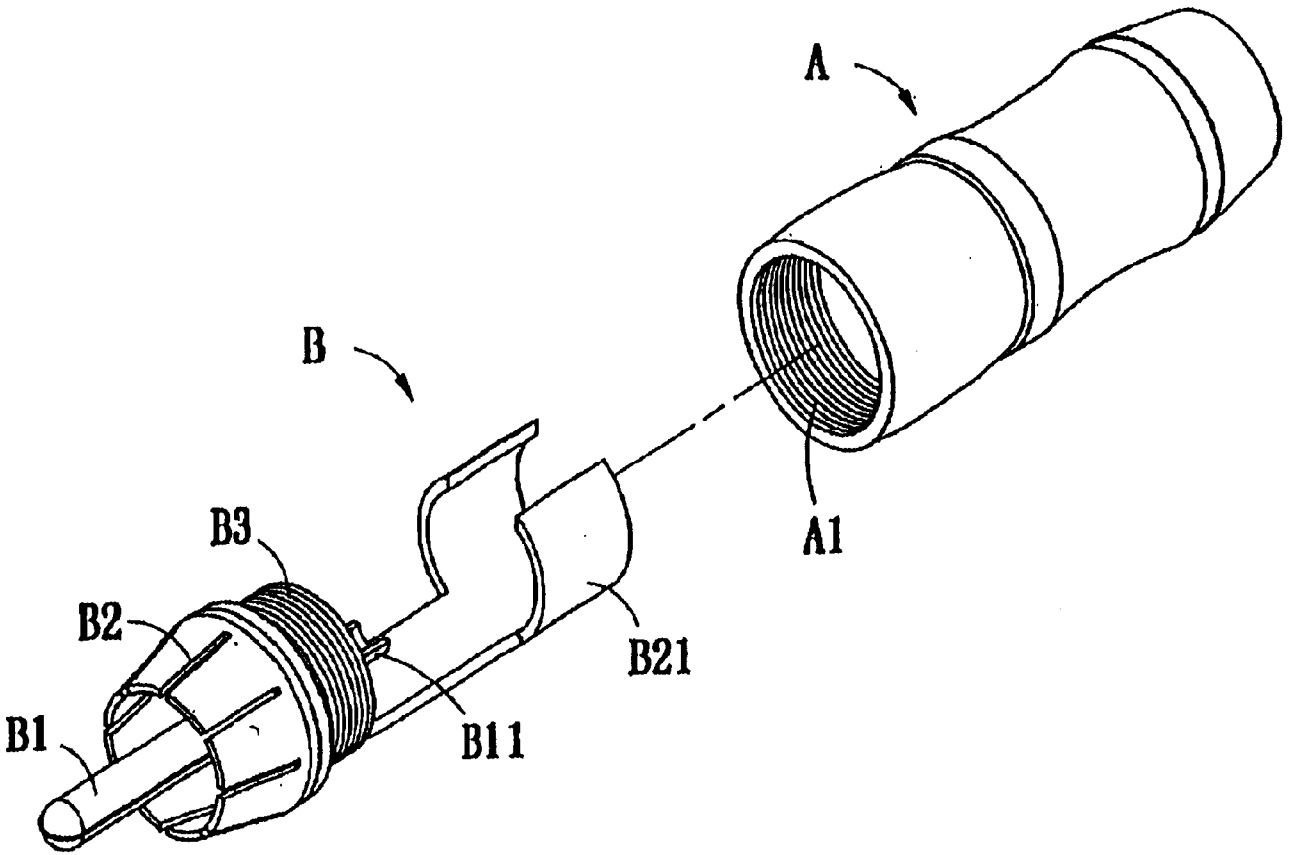
FIG. 1 (PRIOR ART)
FIG. 1 is an exploded perspective view of a conventional signal-line connector.
Figure 2:
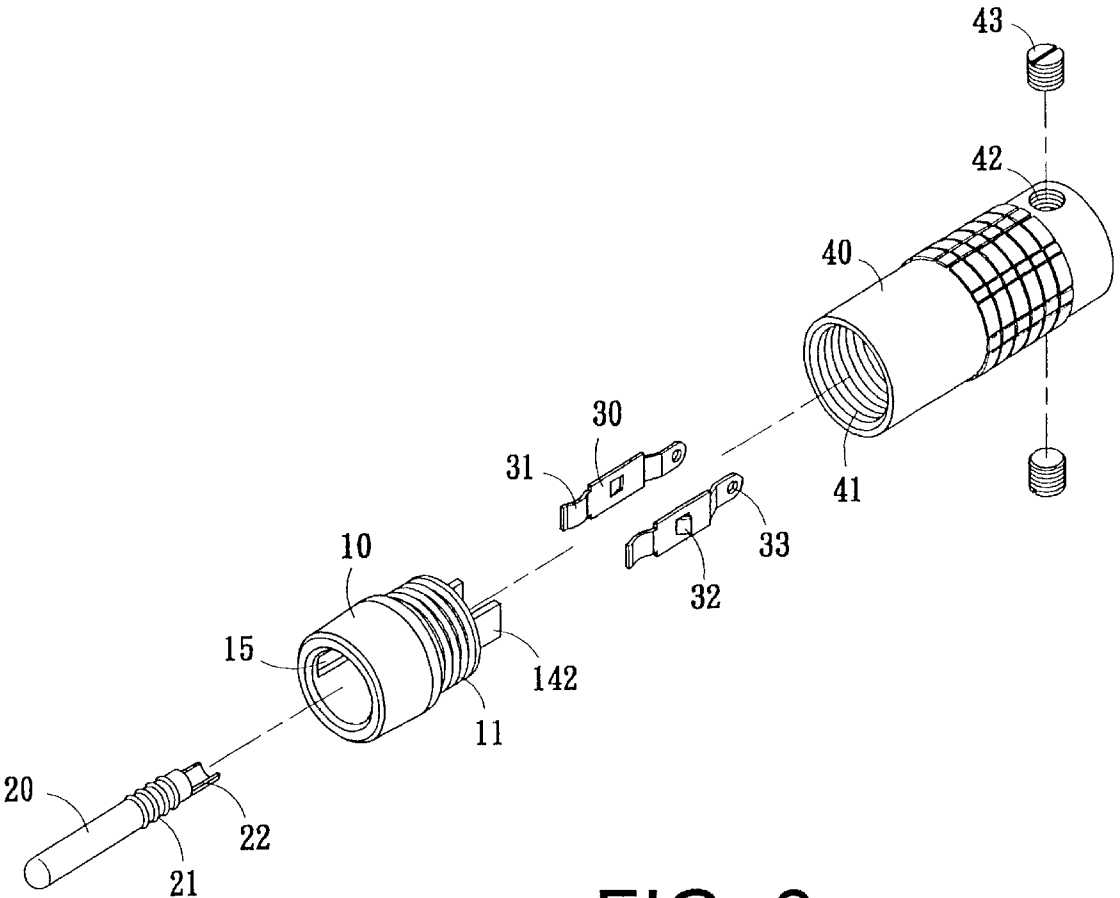
FIG. 2 is an exploded perspective view of a signal-line connector in the present invention.
Figure 3:
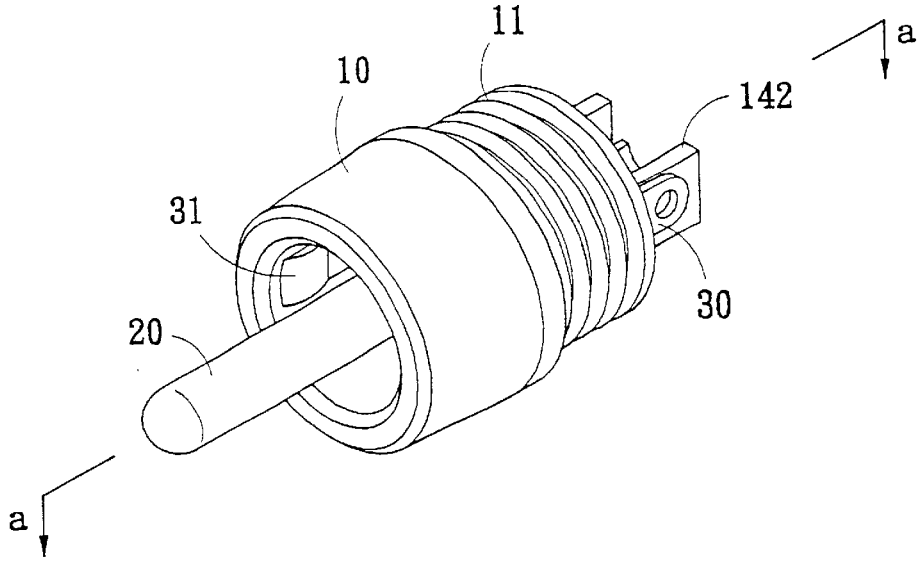
FIG. 3 is a perspective view of the signal-line connector in the present invention.
Figure 3A:
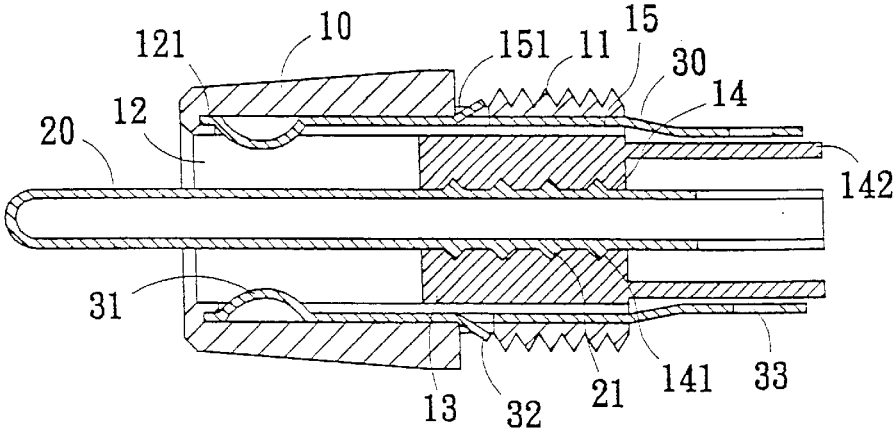
FIG. 3*a* is a cross-sectional view of the signal-line connector in the present invention; and, FIGS. 4 and 5 are cross-sectional views of the signal-line connector in a used condition in the present invention.

A preferred embodiment of a signal-line connector in the present invention, as shown in FIGS. 2, 3 and 3*a*, includes a connecting member 10, a rod-shaped conductor 20 and two grounding members 30, and a shell 40 as main components combined together.

The connecting member 10 is shaped as a short cylinder, having an open end 12 and a closed end 13. Male threads 11 are formed on the outer surface of a rear portion of the connecting member 10, and a center through hole 14 formed in the center of the rear portion. The connecting member 10 further has a fitting groove 15 formed respectively on two opposite sides of the wall defining the center through hole 14 and extending from the closed end to near the open end and having a hole 151 in its intermediate section. More than one annular grooves 141 spaced apart equidistantly are formed in the wall defining the center through hole 14, and two separating strips 142 are formed to extend from the closed end rearward between the center through hole 14 and the two fitting grooves 15. The open end 12 further has an inner barbed annular stop edge 121.

The rod-shaped conductor 20 has the same diameter as that of the center through hole 14 in the rear portion of the connecting member 10, and a length enough to have a rear end plush with the rear end of the separating strips 142 and have a front end extending out of the open end of the connecting member 10, and a plurality of annular projections 21 spaced apart equidistantly in the rear potion to engage with the annular grooves 141 of the connecting member 10, and a rear semi-circular connecting end 22.

The two grounding members 30 is shaped as a plate strip, respectively inserting in the fitting grooves 15 of the connecting member 10 and having a front curved end 31, an intermediate projecting hook 32 extending to the opposite direction to the front end 31 and a line hole 33 formed near a rear end.

The shell 40 is cylindrical, having female threads 41 formed in an inner wall of the front portion and a threaded hole 42 bored respectively oppositely near a rear end for a bolt 43 to engage with.

In assembling, firstly, the rod-shaped conductor 20 is inserted in the center through hole 13 of the connecting member 10, with the annular projections 21 forced to fit in the annular grooves 141 of the connecting member 10. Then the two grounding members 30 are pushed in the two fitting grooves 15 with the front curved end 31 headed forward, with the front curved end 31 fitting in the end of the fitting grooves 15, with its front end edge stopped by the barbed annular stop edge 121, and with the projecting hook 32 engaging the hole 151 so that the rod-shaped conductor 20 and the two grounding members 30 are combined stably with the connecting member 10. Lastly, the shell 40 is screwed to engage with the connecting member 10 from behind, finishing the assembly of the signal-line connector.

In using, the signal lines are made to extend through the shell 40 and respectively connected with the semi-circular connecting end 22 of the rod-shaped conductor 20 and the wire holes 33 of the two grounding members 30, and then welded together. Then the shell 40 is screwed to engage with the connecting member 10 (not shown), and at the same time, the bolts 43 are screwed in the threaded holes 42 of the shell 40 to tightly hold the ends of the signal lines so as to prevent the signal lines from falling off the conductor 10 or the grounding members 30 owing to vibration. As a gap is formed between the conductor 20 and the two grounding members 30 so that the signal lines may never contact each other accidentally. In addition, the separating strips 142 positioned between the center through hole 14 and the two fitting grooves 15 may also effectively separate the signal lines to avoid accidental mutual contact.

Figure 4:
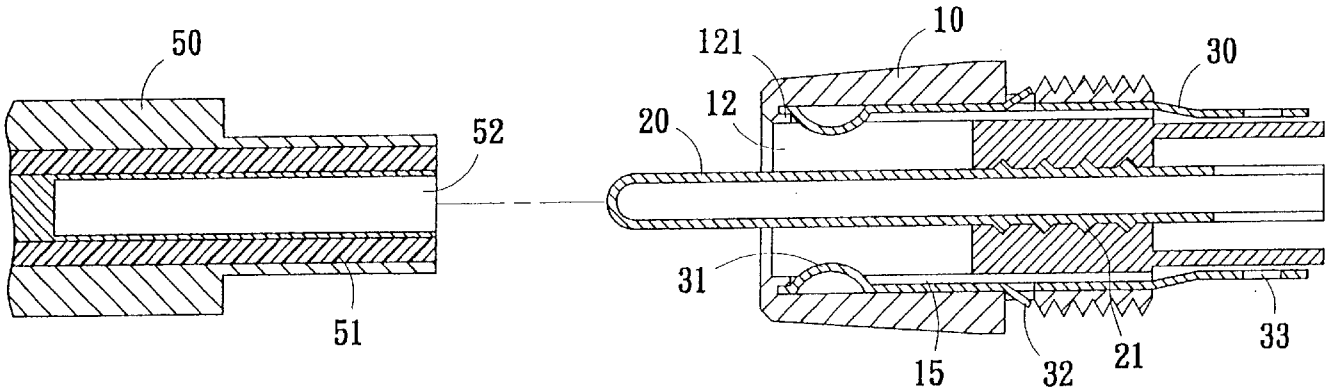
Figure 5:
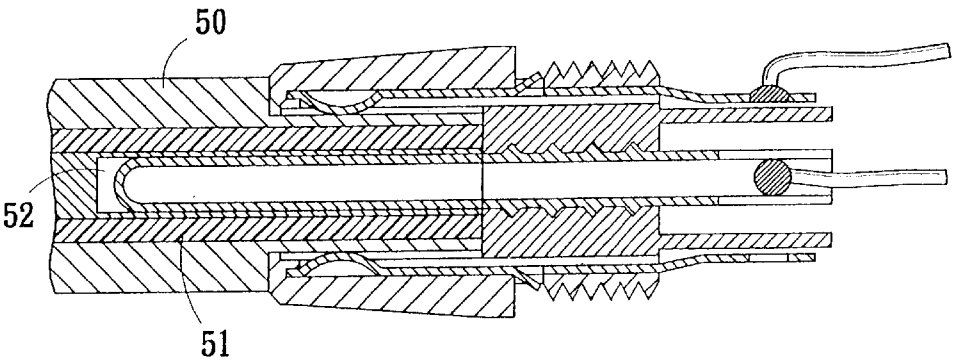

Furthermore, when the connecting member 10 is inserted in a socket 50 as shown in FIGS. 4 and 5, the rod-shaped conductor 20 extends in the center hole 52 of a rear small portion 51 of the socket 50, with the rear portion 51 inserting in the center hole of the front portion of the connecting member 10. Then the front curved-up ends 31 of the grounding members 30 may push against the rear end of the rear portion 51 so the signal-line connector and the socket 50 are firmly combined together, So the open end 12 surrounds tensely the rear portion 51 of the socket 50, and the connecting member 10 may not loosen to cause inferior contact, even in case of using the signal-line connector for a long period of time.

As can be understood from the foresaid description, the invention has the following advantages.

1. The two grounding members use metal material of a small size, and have a curved-up end to contact tightly with a rear portion of a socket when the signal-line connector is connected with the socket.

2. The two grounding members have little resistance, as they are made integral with conductive metal. And the connecting member is made of non-metal such as plastic, having low capacitance to be able to elevate frequency band and signal transmission.

3. The separating strips are provided between the rod-shaped conductor and the grounding members, preventing the signal lines from contacting each other accidentally or inadvertently.

4. The curved-up ends and projecting hooks of the grounding members push and engage with each other tightly, so the grounding members can be combined with the connecting member, which can then be combined with a socket stably and tightly by means of the squeeze of the front curved-up ends.

While the preferred embodiment of the invention has been described above, it will be recognized and understood that various modifications may be made therein and the appended claims are intended to cover all such modifications that may fall within the spirit and scope of the invention.

I claim:

1. A signal-line connector comprising:

a connecting member made of insulating material such as plastic and shaped as a cylinder, said connecting member having an open end and a closed end, said closed end with a rear portion of said connecting member having a center through hole and two fitting grooves formed opposite in a wall defining said center through hole and extending to said open end, a separating strip provided respectively between said center through hole and said fitting grooves;

a rod-shaped conductor provided to have a rear end extending through said center through hole of said connecting member and a front end extending out of said open end of said connecting member;

two grounding members respectively fitting in said fitting grooves, having a front curved-up end;

a shell shaped cylindrical, having female threads in its inner wall to engage with said connecting member.

2. The signal-line connector as claimed in claim 1, wherein a wall defining said center through hole is provided with a plurality of annular grooves spaced apart equidistantly, and the diameter of said center through hole is the same as that of the rod-shaped conductor, which has the same number of annular projections as said annular grooves to engage with.

3. The signal-line connector as claimed in claim 1, wherein said fitting grooves respectively have a hole bored in its intermediate section.

4. The signal-line connector as claimed in claim 1, wherein said grounding members respectively have a projecting hook formed in its intermediate portion, said hook is oriented opposite to the front curved end, and the said projecting hook fits in said hole of each said fitting groove.

* * * * *